US006859980B2

(12) United States Patent
Baer

(10) Patent No.: US 6,859,980 B2
(45) Date of Patent: Mar. 1, 2005

(54) COVERED PINNED HINGE

(76) Inventor: Austin R. Baer, 24416 Highway 550, Ridgway, CO (US) 81432

( * ) Notice: Subject to any disclaimer, the term of this patent is extended or adjusted under 35 U.S.C. 154(b) by 0 days.

(21) Appl. No.: 10/164,173

(22) Filed: Jun. 6, 2002

(65) Prior Publication Data

US 2003/0226238 A1 Dec. 11, 2003

(51) Int. Cl.[7] ..... E05D 7/00
(52) U.S. Cl. ..... 16/354; 16/250
(58) Field of Search ..... 16/354, 355, 356, 16/250, 251; 49/383; 160/206, 213, 229.1, 231.2, 235

(56) References Cited

U.S. PATENT DOCUMENTS

| | | | | | |
|---|---|---|---|---|---|
| 591,359 | A | | 10/1897 | Pomeroy | |
| 1,552,916 | A | | 9/1925 | Farrington | |
| 2,342,453 | A | | 2/1944 | Colucci | 16/148 |
| 3,092,870 | A | * | 6/1963 | Baer | 16/277 |
| 3,121,946 | A | | 2/1964 | Young | 29/434 |
| 3,128,898 | A | | 4/1964 | Burman, Jr. | 220/35 |
| 3,374,499 | A | | 3/1968 | Horstman | 16/163 |
| 3,402,422 | A | | 9/1968 | Baer | 16/163 |
| 3,499,183 | A | | 3/1970 | Parsons | 16/136 |
| 3,787,923 | A | | 1/1974 | Peterson | 16/184 |
| 3,837,042 | A | | 9/1974 | White | 16/140 |
| 3,921,225 | A | | 11/1975 | Suska | 16/136 |
| 3,973,289 | A | * | 8/1976 | Yulkowski | 16/371 |
| 3,999,246 | A | | 12/1976 | Suska | 16/136 |
| 4,039,163 | A | | 8/1977 | Shorey | 244/137 |
| 4,056,985 | A | * | 11/1977 | Worrallo | 74/435 |
| 4,097,959 | A | | 7/1978 | Johnson | 16/136 |
| 4,284,861 | A | | 8/1981 | Senften | 200/61.7 |
| RE30,873 | E | | 3/1982 | Worrallo | 16/354 |
| 4,353,146 | A | | 10/1982 | Brockhaus | 16/387 |
| 4,419,788 | A | | 12/1983 | Prout | 16/300 |
| 4,570,291 | A | * | 2/1986 | Smith et al. | 16/250 |
| 4,583,262 | A | | 4/1986 | Werner | 16/300 |
| 4,679,277 | A | | 7/1987 | Shibata | 16/354 |

(List continued on next page.)

FOREIGN PATENT DOCUMENTS

| | | | |
|---|---|---|---|
| DE | 24 57 413 | | 6/1975 |
| FR | 1448729 | | 8/1966 |
| JP | 11-182125 | * | 7/1999 |

OTHER PUBLICATIONS

Brochure—Roton Continuous Hinge, Roton Corporation, 1989.

*Primary Examiner*—Chuck Y. Mah
(74) *Attorney, Agent, or Firm*—Morgan, Lewis & Bockius LLP

(57) ABSTRACT

A slim profile covered pinned hinge is provided which comprises a first hinge member, a second hinge member, and a mechanically articulated cover. The first and second hinge members are pivotally connected by a pin. The first and second hinge members may each further comprise a leaf for attachment to a hinged object, a door or door jamb for example, and at least one knuckle through which the pin may be received. The cover may be elongated and has an internal cavity, thereby allowing the cover to be slipped over the hinge concealing the knuckles and joints therebetween of the hinge members. The cover has two ends and may be mechanically coupled to the pin at one or both ends. In one embodiment, at least one end of the pin may have at least two gears comprising a gear segment. The ends of the cover may have at least one gear rack to engage the gears on the end of the pin. Angularly opening and closing the first and second hinge members moves the cover with respect to the pin, providing additional clearance to allow for the leaves of the hinge members to swing as the hinge is operated.

35 Claims, 9 Drawing Sheets

U.S. PATENT DOCUMENTS

| | | | | | |
|---|---|---|---|---|---|
| 4,684,017 | A | | 8/1987 | Watanabe et al. | 206/235 |
| 4,761,853 | A | | 8/1988 | Hoffman | 16/302 |
| 4,765,027 | A | * | 8/1988 | Andric | 16/354 |
| 4,976,008 | A | | 12/1990 | Baer | 16/354 |
| 4,996,739 | A | | 3/1991 | Baer | 16/354 |
| 4,999,878 | A | | 3/1991 | Baer | 16/354 |
| 4,999,879 | A | | 3/1991 | Baer | 16/354 |
| 4,999,880 | A | | 3/1991 | Baer | 16/354 |
| 5,001,810 | A | | 3/1991 | Baer | 16/302 |
| 5,062,181 | A | | 11/1991 | Bobrowski et al. | 16/354 |
| 5,075,928 | A | | 12/1991 | Bobrowski | 16/273 |
| 5,081,742 | A | | 1/1992 | Kobayashi | 16/337 |
| 5,121,521 | A | | 6/1992 | Hagiwara et al. | 16/278 |
| 5,201,902 | A | | 4/1993 | Baer | 16/354 |
| 5,363,089 | A | | 11/1994 | Goldenberg | 340/825.44 |
| 5,443,444 | A | * | 8/1995 | Pruyssers | 602/26 |
| 5,455,987 | A | | 10/1995 | Svehaug | 16/267 |
| 5,542,152 | A | | 8/1996 | Crompton et al. | 16/354 |
| 5,566,424 | A | | 10/1996 | Crompton et al. | 16/342 |
| 5,662,596 | A | * | 9/1997 | Young | 602/26 |
| 5,685,045 | A | | 11/1997 | Lace | 16/354 |
| 5,778,491 | A | | 7/1998 | Baer | 16/354 |
| 5,991,975 | A | | 11/1999 | Baer | 16/354 |
| 6,073,310 | A | | 6/2000 | Baer | 16/354 |
| 6,170,210 | B1 | | 1/2001 | Marts | 52/232 |
| 6,173,475 | B1 | | 1/2001 | Senn et al. | 16/273 |
| 6,385,815 | B1 | | 5/2002 | Hayashida et al. | 16/342 |
| 2002/0035765 | A1 | | 3/2002 | Baer | 16/354 |

* cited by examiner

COVERED PINNED HINGE

BACKGROUND OF THE INVENTION

The present invention generally relates to butt hinges, and more particularly, to an improved covered and pinned butt hinge with a slimmer appearance.

The butt hinge, also known as a mortise hinge because it is normally mortised or inset into the door jamb (frame) and into the edge of the door, is well-known in the hardware industry. Over the years, many improvements have been made to both improve its longevity and to improve its appearance. Among the developments that enhance the service life of butt hinges, particularly those used in commercial applications, is the inclusion of bearings of different kinds to reduce friction. Bronze bearings, ball bearings and friction-resistant plastic bearings have all been successfully used. Improvements in appearance have generally been limited to reducing the number of joints which occur between the interposed leaves, or reducing the size of the bearings, often at the expense of hinge performance.

The most common hinge configuration is the "five-knuckle" hinge, which is constructed from a pair of leaves and a pin around which the leaves rotate. One leaf generally has three knuckles, while its opposing leaf has two. Thrust bearings, or combinations of radial and thrust bearings are most often visible between the knuckles, adding to the complexity of the design and often compromising the appearance of the hinge. In a five knuckle hinge, either two or four bearings are used between the knuckles, depending on the service requirements of the hardware. However, only half the number of installed bearings actual carry the weight of the door, because the other two are located on those knuckle surfaces which tend to separate rather than compress when the door is installed. When such a hinge is inverted for use on doors of the opposite "hand" or swing direction, the inactive bearings will carry the weight of the door. For simplicity in manufacturing and stocking butt hinges, nearly all hinges all built to carry the door load for either right- or left-hand installations.

The history of mortise hinge development includes many attempts to refine the outward appearance of these products by reducing the number of knuckles, thereby reducing the number of unsightly joints between them. There have been designs which limit the number of knuckles to two on one leaf, and one on the other. The consequence of this design is that only one bearing is actually carrying the load for such an assembly, but bearings, if used, are always installed on both sides of the center knuckle so that the hinge can be inverted as explained above. Even more recently, butt hinges have been designed with only one knuckle on each leaf, with a bearing in between. Such hinges are thought to be a further improvement in appearance, but they must be manufactured in both left- and right-hand versions so that they can carry doors of either "hand." This makes manufacturing and distribution more complex, because incorrect specification resulting in delays and consequential added costs often accompanies such products. Clearly, the trend toward the elimination of unsightly joints has fostered the development of butt hinges with ever-fewer knuckles, even at greater cost, inconvenience, and degradation of hinge performance.

SUMMARY OF THE INVENTION

The invention which will be described provides a mechanically articulated covering member which not only hides the knuckles, joints, and bearings, but can be modified in contour as well as provide a variety of materials and colors which may be different from those used to form the leaves.

Another advantage of the invention is that the angular position of the cover is designed to continually bisect the angle formed by the leaves, and remain properly indexed throughout the angular travel of the leaves, or, by minor modification to the design, move slightly more in its angular relationship to one or the other of the leaves to accommodate any special geometrical or appearance requirements that might be encountered in certain installations.

Yet another advantage of the invention is that the covering member may be designed for installation or replacement by the distributor or at the jobsite. This means that the manufacturer does not need to be concerned with the color or material of the final product at the outset. The distributor is likewise able to use his inventory with the greatest flexibility and buying efficiency by purchasing the hinge "chassis" in large quantities, and assembling a cover of the user's choice at the point of sale.

Another advantage of the invention is the greatly reduced cost of hinge hardware which would otherwise require manufacture in costly materials, which are often not suitable for high-stress applications. For example, a "brass" hinge could be made with inexpensive, painted or plated steel leaves and equipped with a cover in polished brass, brushed brass, or brass with an "antiqued" or bronze color. Such a hinge would be far stronger and manufactured at a fraction of the cost of a solid brass hinge. Further, the delivery time for this product would be drastically reduced by combining a standard, mass-produced hinge "chassis" with any one of a variety of inexpensive covers in any desired color or material, including plated, polished or brushed metal, or plastics. The hinge "chassis" can be equipped with whatever number of joints and bearings are best suited for the service requirements of the application without regard to the outward appearance of its mechanical design, which will be covered along its entire length. Clearly, the possibilities for improved hinge appearance at very low cost are unique with this invention, which at the same time makes it possible, for the first time, to paint a hinge repeatedly without fear of chipping at the joints, or to clad it with wallpaper or even a wood veneer without consequence.

A pinned hinge formed according to principles of the present invention comprises first and second hinge members and a cover. The first and second hinge members may be pivotally connected by a pin having two ends. At least one end of the cover may be mechanically coupled with one end of a pin. In one embodiment, at least one gear is disposed on one end of the pin to mechanically couple the cover to the pin. Preferably, the gear in one embodiment has a gear segment comprising gear teeth extending partially around the circumference and outer surface of the gear. In another embodiment, at least one end of the cover has a gear rack to engage the at least one gear disposed on one end of the pin. In yet another embodiment, the end of the cover may have an end cap in which the gear rack is disposed.

The hinge members may each have a leaf for attachment to a hinged object and at least one knuckle in which a pin may be received. The knuckles may have passageways which are preferably axially aligned with the other knuckles of a hinge member. When the hinge is assembled by joining the first and second hinge members together, the passageways of the first and second hinge members are preferably substantially coaxially aligned for insertion of the pin through both members.

A hinge cover may be elongated and have two ends. The hinge cover may be substantially hollow, having an internal cavity which may be placed over the knuckles of a hinge member. In one embodiment, angularly opening and closing the first and second hinge members causes the cover to be displaced or moved with respect to the pin. The leaves of each hinge member angularly move apart in defining "opening" of the first and second hinge members, and the leaves angularly move towards each other in defining "closing" of the hinge members. In another embodiment, the cover preferably is displaced or moved linearly with respect to the pin as the first and second hinge members are opened and closed. In yet another embodiment, the cover may be displaced both linearly and arcuately with respect to the pin.

In another embodiment, both ends of the cover may be mechanically coupled with both ends of a pin. And the cover may be displaced with respect to the pin in any manner described above. In accordance with another embodiment, the ends of a hinge cover may be mechanically coupled to the ends of a pin by at least one gear disposed on each end of the pin. Preferably, two gears are disposed on each end of the pin. The gears in one embodiment preferably have a gear segment comprising gear teeth extending partially around the circumference and outer surface of the gears. In another embodiment, the ends of the cover may each have at least one gear rack to engage the two gears disposed on each end of the pin. Preferably, at least two gear racks are disposed in each end of the cover. In one embodiment, two gear racks are disposed in each end of the cover which preferably, are arranged in an opposing configuration and aligned vertically with respect to the cover. In another embodiment, the ends of the cover may each have an end cap in which the gear rack or racks are disposed. The gear racks engage the gear or gears disposed on each end of the pin, providing for smooth and continuous indexed radial movement of the cover with respect to the pin.

In an embodiment having two gears disposed on each end of a pin, at least one gear on each end of the pin is disposed adjacent to and rotatably fixed to the first hinge member, thereby causing the fixed gear to rotate or turn in unison with the first hinge member. This fixed gear may be referred to as the "inboard" gear for convenience, which preferably is fixed to a knuckle of the first hinge member. In another embodiment, the remaining gear on each end of the pin is disposed near to and outside of the inboard gear; the remaining gear may be referred to as the "outboard" gear for convenience. Preferably, the outboard gear is rotatably fixed to the end of the pin and more preferably, the second hinge member is also rotatably fixed to the pin. Accordingly, the outboard gear and second hinge member rotate or turn in unison with the pin.

The foregoing and other embodiments will be described in detail below with reference to the drawing provided herewith.

BRIEF DESCRIPTION OF THE DRAWINGS

The features and advantages of the present invention will become more readily apparent from the following Description of the Preferred Embodiments of the invention in which like elements are labeled similarly, and in which.

DESCRIPTION OF THE PREFERRED EMBODIMENTS

Figure 1:
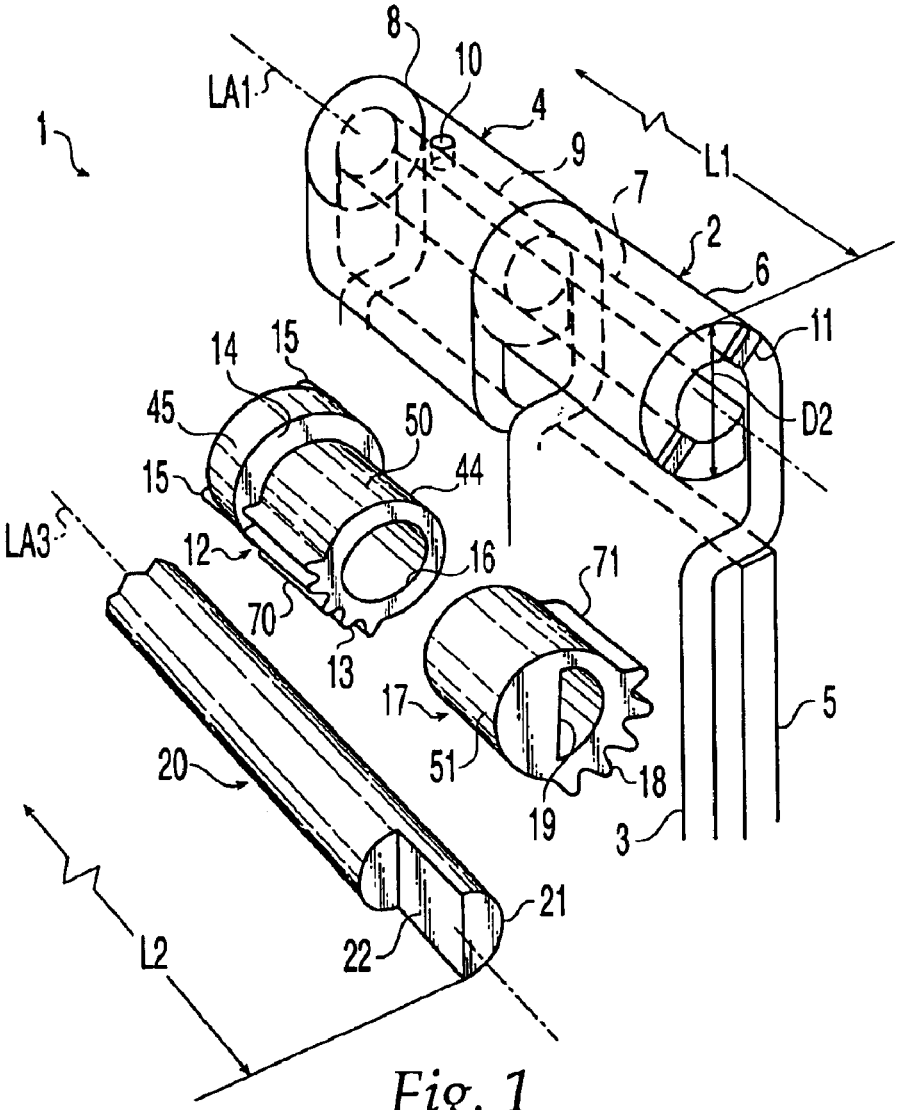
FIG. 1 is an exploded perspective view of first and second hinge members, an inboard gear, an outboard gear, and a pin of a hinge according to principles of the present invention, and wherein the foregoing components are shown unassembled.
Figure 6:
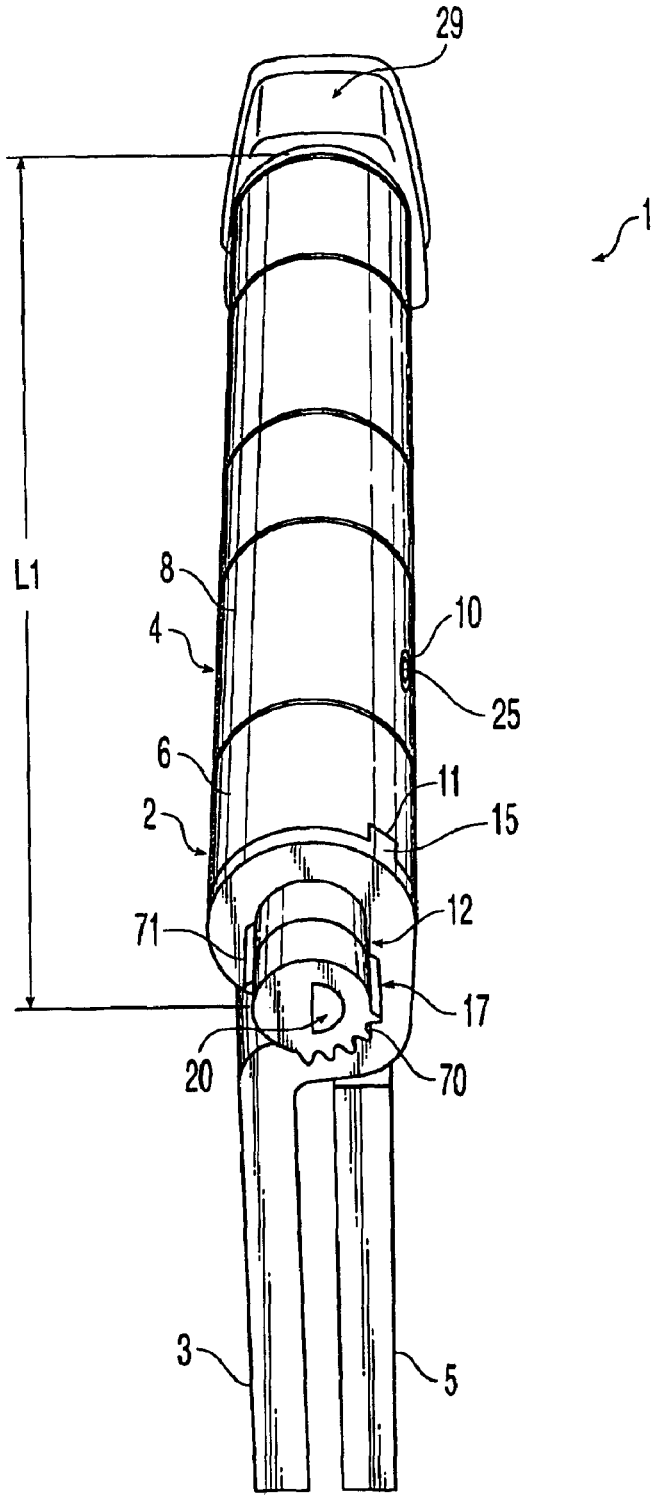
FIG. 6 is a perspective view of a hinge according to principles of the present invention shown in the "hinge closed position" with the bottom end cap and the cover removed.

Referring to FIG. 1, a pinned hinge 1 having a mechanically articulated cover is depicted in one embodiment as including at least two hinge members 2, 4. The hinge members 2, 4 each comprise knuckles or barrels 6, 8 and leaves 3, 5 connected thereto, respectively. In one preferred embodiment (shown in FIGS. 6–8), a five knuckle hinge 1 is provided in which hinge member 2 has three knuckles 6 and hinge member 4 has two knuckles 4, which are interspersed between the knuckles 6 of hinge member 2. A total hinge length L1 (as shown in FIGS. 1 and 6) is defined as the total length through the knuckle portions of the hinge members 2, 4 after the hinge has been assembled, including the contributions to the total length by any bearings or other structures that may be located in the joints between adjacent knuckles.

The knuckles 6, 8 have passageways 7, 9 which extend longitudinally through the knuckles and define a longitudinal axis LA1 through the knuckles 6, 8 and pinned hinge 1. The passageways 7, 9 are configured and adapted to receive a pin 20 which may be slid therethrough and releasably retained therein to pivotally connect hinge members 2 and 4. Preferably, the passageways 7, 9 are substantially circular in cross section to receive pin 20 which is also preferably circular in cross section. It will be appreciated by those skilled in the art that the passageways 7, 9 need not be perfectly circular in cross section, but preferably should be sized and configured such that pin 20 may be received therein without excess play so that the hinge 1 is permitted to function smoothly and properly. Preferably, the passageways 7, 9 of each knuckle are substantially coaxially aligned with the passageways of other knuckles of the same hinge member. The hinge members 2, 4 are cooperatively sized and configured such that the passageways 7, 9 of each hinge member fall into alignment when hinge 1 is assembled with the pin 20 inserted therein.

It should be noted that one or more bearings (not shown) may be interspersed between adjacent knuckles, such practice being well known in the art and described above.

The hinge member leaves 3, 5 are configured and adapted to be attached to hinged objects, such as, for example, a door and door frame jamb (not shown). Typically, one hinge member is attached to one hinged object (e.g., a door) while the other hinge member is attached to the other hinged object (e.g., a door frame). The leaves 3, 5 may be any shape and thickness, which is a matter of design choice and dependent upon the particular installation requirements. It will be appreciated that the pinned hinge 1 is expressly not limited for use in door installations alone, but may be used in any type of application where at least two hinged objects are to be pivotally connected.

The hinge members 2, 4 may be manufactured from a variety of different materials including, but not limited to brass, steel, aluminum, titanium, plastics, composites, etc. The hinge members 2, 4 may be manufactured by techniques known in the art such as, but not limited to roll forming, extruding, casting, molding, etc. The selection of materials and manufacturing techniques are well within the purview of those of ordinary skill in the art and will not be expounded herein.

The pin 20 having a length L2 and two ends is configured and adapted to be received in passageways 7, 9 of the knuckles 6, 8, respectively. When assembled in the knuckles 6, 8, the pin 20 pivotally connects hinge members 2, 4 so that the hinge members may be rotatably moved through an angular displacement measured in degrees of angle θ (shown in FIG. 7) with respect to the pin. Preferably, the length L2 of the pin 20 (which defines a longitudinal pin axis LA3) is greater than the total length L1 of the assembled hinge 1 such that at least part of the ends of the pin extend a predetermined distance beyond the ends of each of the outermost end knuckles 6. Thus, the length of the pin 20 is preferably longer than the length of assembled hinge 1 at the knuckles. Accordingly, when the pin 20 is assembled in the hinge members 2, 4, part of each pin end preferably will extend beyond the confines of the passageway of the outermost end knuckles 6 for the reason discussed immediately below.

Referring to FIG. 1, butt hinge 1 further comprises an inboard gear 12 and an outboard gear 17. In the embodiment shown, the inboard and outboard gears 12, 17 have gear tooth segments 70, 71 comprised of gear teeth 13, 18, respectively. Preferably, the gear tooth segments 70, 71 are disposed circumferentially on at least a portion of the outer surfaces 50, 51 of inboard and outboard gears 12, 17, as shown. More preferably, gear tooth segments 70, 71 each cover about one-fourth of the outer circumference (i.e., on an arc of about 90 degrees) of inboard and outboard gears 12, 17 on the outer surfaces 50, 51, as shown. In other embodiments, the gear tooth segments 70, 71 may comprise more or less than one-fourth of the outer circumference which is a matter of design choice. The gear teeth 13, 18 are cooperatively designed and sized to mate with the teeth 55 of the end cap 29 (see FIG. 4) as described in detail below.

Inboard and outboard gears 12, 17 have internal bores 16, 19, respectively, that are sized and configured to fit on the parts of the pin 20 ends that extend beyond both ends of the butt hinge 1 as described above. Preferably, the bore 16 extends all the way through inboard gear 12 so that the pin 20 may be slid completely through to affix outboard gear 19 to the pin end 21. Preferably, each end of the pin 20 has one inboard gear 12 and one outboard gear 17.

The outboard gear 17 is preferably provided with a gear-to-pin lock mechanism to cause the gear 17 to turn or rotate in unison with the pin 20. In the embodiment shown in FIG. 1, the gear-to-pin lock mechanism may comprise a pin 20 having a flat portion 22 which defines a semi-circular cross-sectional shape of pin end 21 which is cooperatively sized and configured to be received in the outboard gear bore 19 which similarly has a semi-circular cross-sectional shape. It will be appreciated that other cross-sectional configurations of the pin end 21 and outboard gear bore 19 may be used. For example, the pin end 21 may be a conventional hex shape and the outboard gear bore 19 may be a mating hex shape. Accordingly, the invention is not limited to shapes of the pin end 21 and outboard gear bore 19 disclosed herein. It should further be noted that outboard gear bore 19 need not extend all the way through gear 17. Thus, embodiments are possible wherein outboard gear bore 19 extends only partially through outboard gear 17, thereby forming a socket (not shown). Also, other possible design approaches are possible to fix or secure outboard gear 17 to the pin 20. For example, an outboard gear 17 may be affixed to a pin 20 by a set screw or pin, press or shrink fitting, adhesives, welding, soldering, or any other means within the common knowledge of those skilled in the art as a matter of design preference. The purpose of the gear-to-pin lock mechanism will become apparent in discussing how the covered pinned hinge operates as described in detail below.

Referring to FIG. 1, inboard gear 12 may have a smaller diameter portion 44 and a larger diameter portion 45. Preferably, the outside diameter of the larger diameter portion 45 of inboard gear 12 is about the same as or less than the outside diameter D2 of the hinge knuckles, for reasons which will become apparent hereafter. The intersection between smaller and larger diameter portions 44, 45 forms an annular surface or shoulder 14. The shoulder is preferably flat as shown, or may be ramp-like with an incline as a matter of design choice.

Inboard gear 12 preferably has a gear-to-knuckle lock mechanism which ensures that the gear 12 turns or rotates in unison with the knuckles 6 of hinge member 2. The gear-to-knuckle lock mechanism may comprise at least one key 15 on the larger diameter portion 45 of inboard gear 12 which is configured and adapted to mate with at least one keyway 11 formed in the end knuckle 6 of hinge member 2. In the embodiment shown, the key 15 projects rearwards from larger diameter portion 45 of the inboard gear 12. Preferably, the key 15 does not project above the profile of the larger diameter portion 45 of the inboard gear 12 to avoid interference with the cover 26 and smooth operation of the hinge 1. Preferably, as shown in FIG. 1, two keys 15 and two keyways 11 are provided.

Because the inboard gear 12 is not secured to the pin 20 which passes through bore 16 therein, gear 12 is free to rotate independently of the pin. Accordingly, locking the inboard gear 12 to the end knuckle 6 of hinge member 2 allows the inboard gear and knuckle 6 to turn in unison without binding with the pin 20. The purpose of the gear-to-knuckle lock mechanism will become apparent in discussing how the covered pinned hinge operates as described in detail below.

It should be noted that the gear-to-knuckle lock mechanism is not limited to the embodiment shown and described above, and other suitable ways of causing the inboard gear 12 and knuckle 6 of hinge member 2 to turn or rotate in unison are possible. For example, the inboard gear 12 may be affixed to knuckle 6 by adhesives, welding, soldering, or any other means within the knowledge of those skilled in the art as a matter of design preference. In one alternative embodiment, for instance, a keyway may be provided in both the larger diameter portion 45 of inboard gear 12 and in knuckle 6 which are circumferentially aligned, and together form a single combined keyway (not shown). A separate key may then be inserted into such a combined keyway to provide a gear-to-knuckle lock mechanism. Preferably, at least two such combined keyways are provided.

Figure 9:
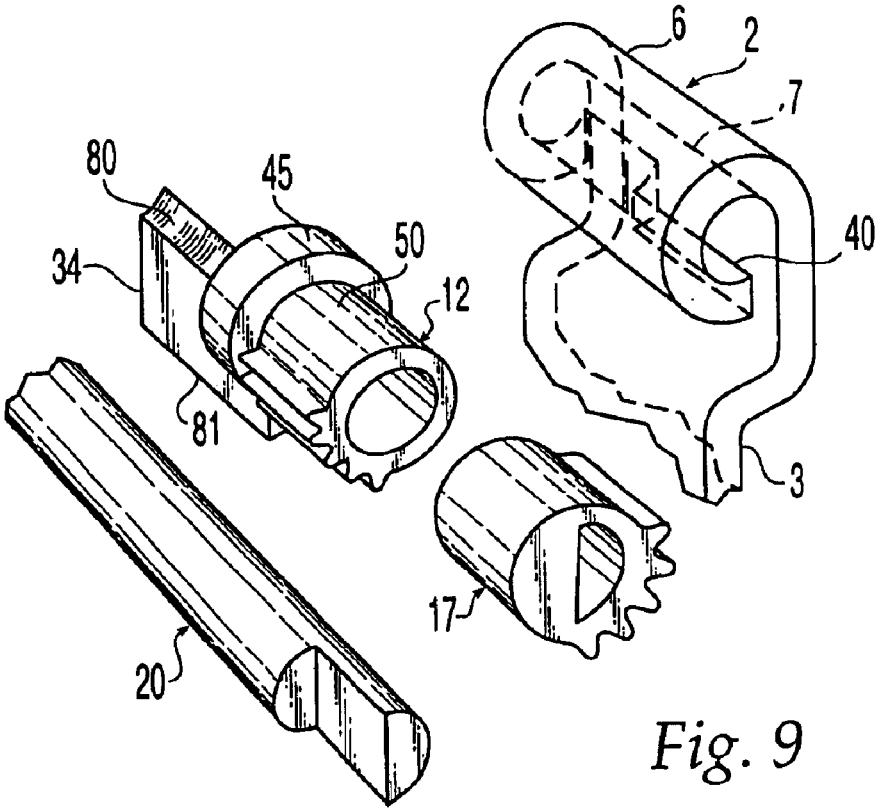
FIG. 9 is an exploded perspective view of a knuckle of a hinge member, an inboard gear, an outboard gear, and a pin of a hinge according to principles of the present invention, and wherein the foregoing components are shown unassembled.
Figure 10:
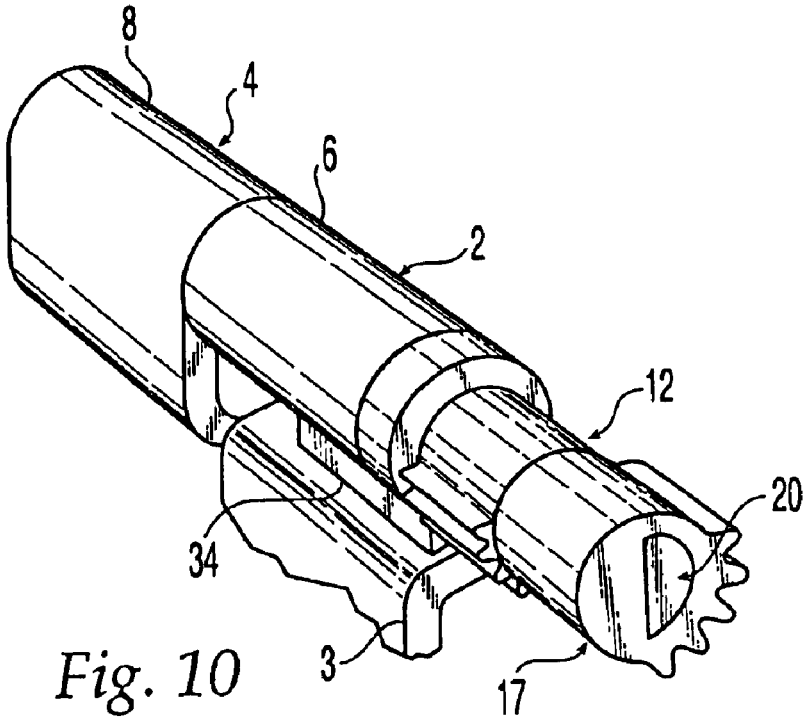
FIG. 10 is a perspective view of a knuckle of a hinge member and the knuckle, inboard gear, outboard gear, and pin of the hinge of FIG. 9 shown assembled.

FIGS. 9 and 10 show yet another possible embodiment for a gear-to-knuckle lock mechanism. In lieu of a key or keys 15 as described above, inboard gear 12 may have a tongue 34 which preferably is substantially rectangular or square in profile. The tongue 34 is attached to and projects from the outer surface 50 of the inboard gear 12. Preferably, in the embodiment shown, the tongue 34 may be attached to the larger diameter portion 45 of the inboard gear 12. The tongue 34 may have a top edge 80 and a bottom edge 81. The top edge may be straight, or preferably as shown, may have a slight radius contoured to match outer radius of the pin 20 and/or the radius of the passageway 7 of knuckle 6. The tongue 34 preferably is formed integral with the inboard gear 12, but may also be a separate component which is attachable to the inboard gear. It should be noted that many possible variations in the size and shape of the tongue 34 are possible, and the invention is not limited in this regard.

Referring to FIGS. 9 and 10, in lieu of a keyway 11 as described above, knuckle 6 may have a longitudinal slot 40 as shown which is cooperatively configured and sized to receive the tongue 34. Preferably, a relatively snug fit is provided between the slot 40 and tongue 34 to minimize play between the knuckle 6 and inboard gear 12. FIG. 10 shows the tongue 34 inserted in and engaged with the slot 40. Thus, inboard gear 12 turns or rotates in unison with the knuckles 6 of hinge member 2. It should be noted that the tongue 34 and slot 40 are configured, sized, and located on each member respectively so that the pin 20 may be freely inserted through the passageway 7 (see FIG. 1) of knuckle 6 and inboard gear 12, and proper operation of the hinge 1 is not impaired after the tongue has been inserted in the slot.

With reference to FIG. 1, the knuckle 8 of hinge member 4 preferably has a knuckle-to-pin lock mechanism to cause the knuckle to turn or rotate in unison with the pin 20. In one embodiment, shown in FIG. 3, a threaded hole 10 (also shown in FIG. 1) is provided through the knuckle 8 from the outside to the internal passageway 9. After the pin 20 is in its final operating position within the passageway 9, a set screw 25 (shown in FIG. 3) is installed in hole 10 to rotatably fix or lock the knuckle 8 and pin together. The purpose of the knuckle-to-pin lock mechanism will become apparent in discussing how the covered pinned hinge operates as described in detail below. It should be noted that the knuckle-to-pin lock mechanism is not limited to the foregoing embodiment, and other suitable ways may be used to fix or lock the knuckle 8 to the pin 20 as will be known to those skilled in the art.

Figure 3:
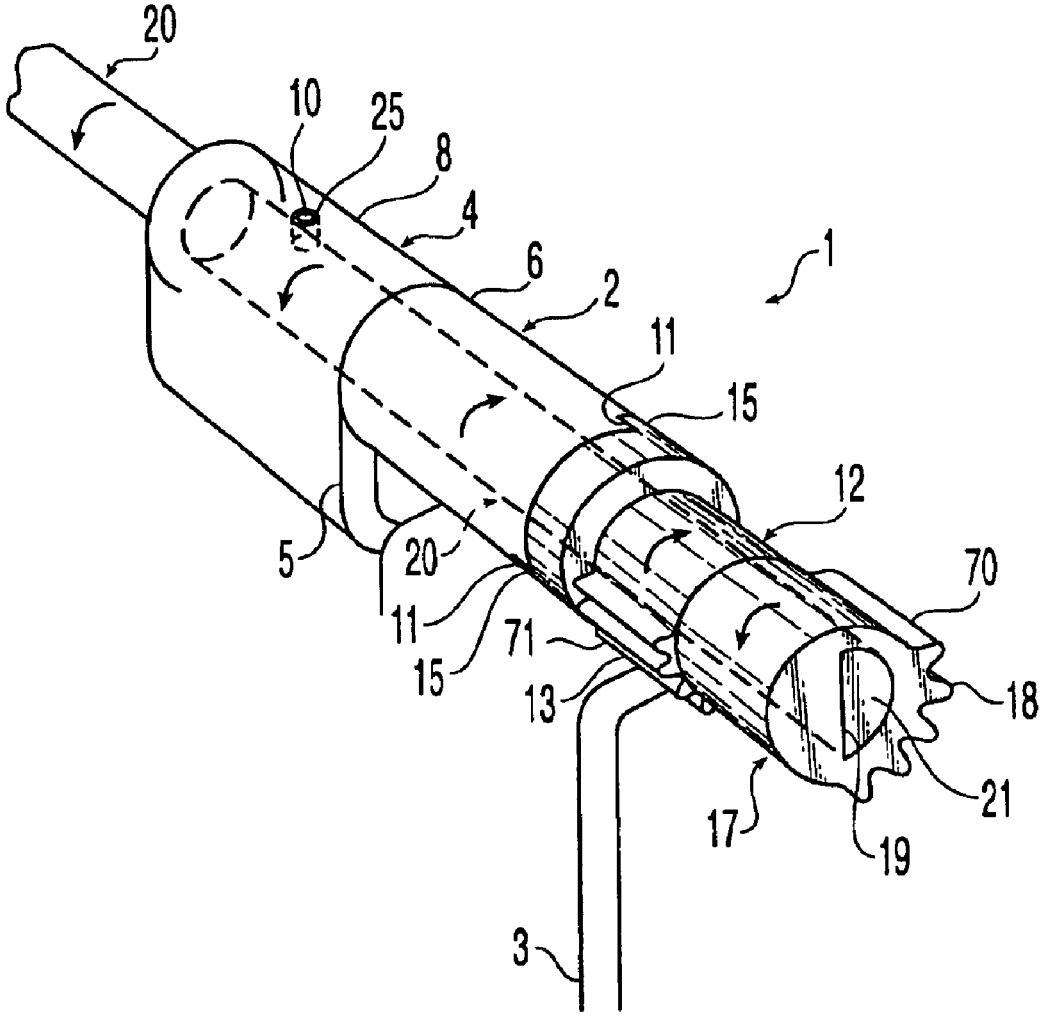
FIG. 3 is a perspective view of the hinge members, inboard gear, outboard gear, and pin of the hinge of FIG. 1 shown assembled.

The pinned hinge 1 components of FIG. 1 are shown assembled in FIG. 3. The knuckles 6, 8 of hinge members 2, 4 are axially aligned and pin 20 is received through knuckle passageways 7, 9. Inboard gear 12 is disposed next to the end knuckle 6 of hinge member 2 with the keys 15 of gear 12 resting in the keyways 11 of the knuckle 6. The pin 20 passes through the bore 16 (not shown) of inboard gear 12 and into the bore 19 of outboard gear 17. As shown by the directional arrows, the inboard gear 12 and the knuckle 6 of hinge member 2 are in fixed rotational relationship with each other. Similarly, the outboard gear 17, pin 20, and knuckle 8 of hinge member 4 are in fixed rotational relationship with each other.

It should be noted that while only one end of pinned hinge 1 is shown in FIG. 3, the opposite end is preferably provided with the same compliment and arrangement of the components. However, the size and configuration of components on both ends of the pin do not necessarily have to be identical in some embodiments and is a matter of design choice.

Figure 4:
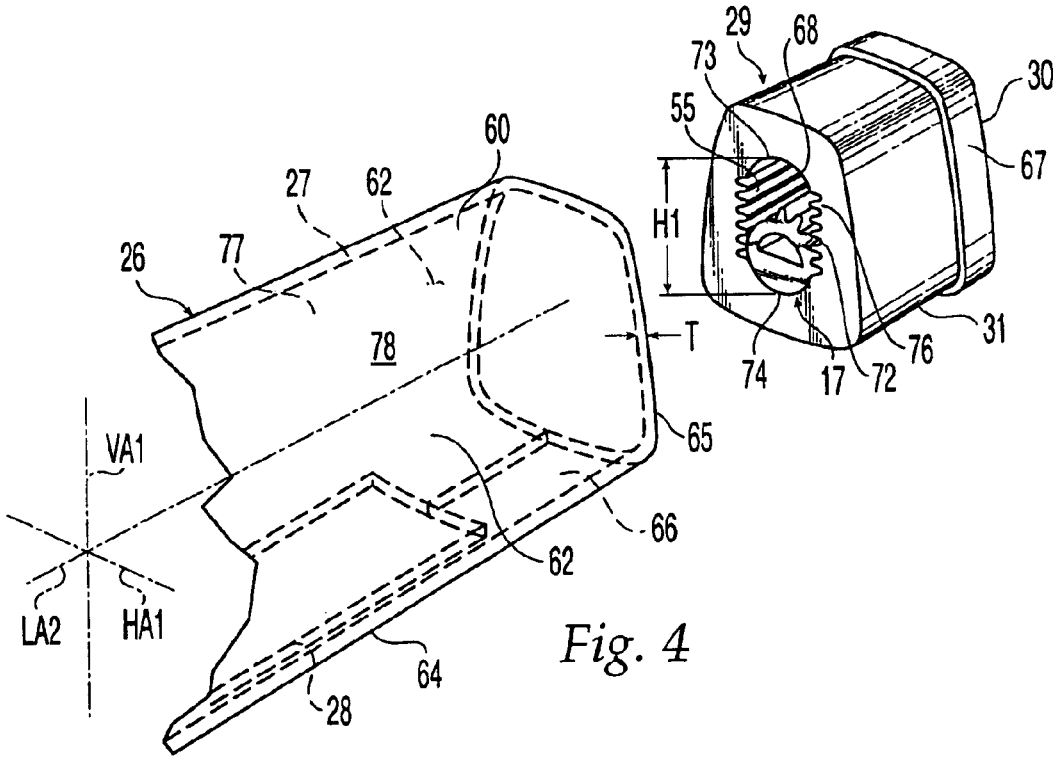
FIG. 4 is an exploded perspective view of a cover and an end cap of a hinge according to principles of the present invention.
Figure 8:
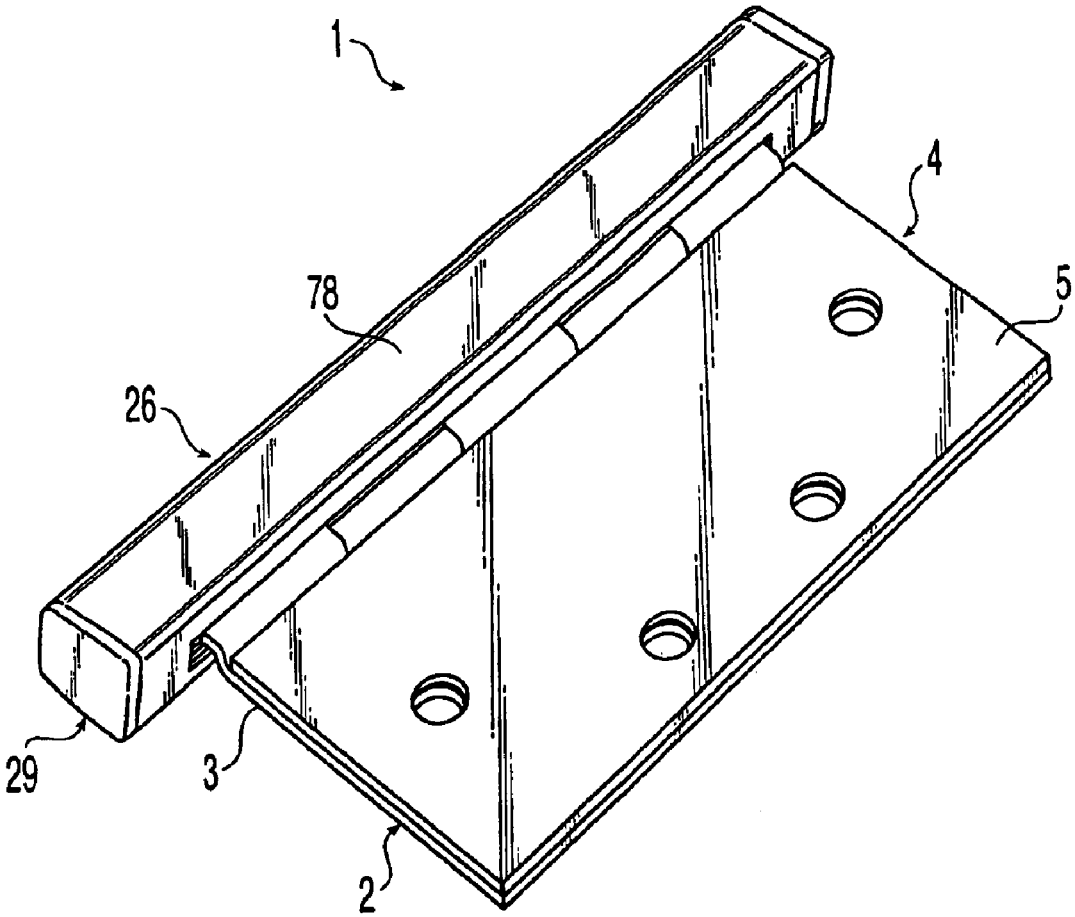
FIG. 8 is a perspective view of a hinge according to principles of the present invention shown fully assembled in the "hinge closed position"

As shown in one embodiment in FIG. 4, the covered hinge may have an elongated hollow cover 26 having an inner surface 77 and outer surface 78 (better seen in FIG. 8). The cover 26 further comprises a top 60, two opposing sidewalls 62, and a bottom 64. An open cavity 27 extends through the cover 26 from end 65 (shown) to the opposite end (not shown). An elongated window 28 may be formed in the bottom 64 of the cover 26 for external access to the cavity 27, thereby allowing the cover to be slipped over the knuckles 6, 8 of the hinge members 2, 4. A bottom end closure 66 may be provided on each end 65 of the cover 26 as shown to assist in retaining and supporting an end cap 29.

The cover 26 serves to at least partially conceal the knuckles 6, 8 from plain sight, and to offer some protection from the environment and vandalism.

The cover 26 may further be defined to have a vertical axis VA1, horizontal axis HA1, and longitudinal axis LA2. The vertical axis VA1 will be convenient in describing the position of the cover 26 as the hinge is operated, which is discussed in detail below.

The cover 26 may preferably be made from aluminum, steel, titanium, alloyed metals, plastic, or any other suitable material as commonly known and used in the art. The cover 26 may be made by extrusion or any other suitable manufacturing method commonly known and used in the art. Preferably, the cover 26 is formed by rolling or stamping sheet material. This allows a relatively thin cross-sectional profile for the cover 26 which conforms with the industry-expressed preference for slimmer hinges, especially in the field of butt hinges. Accordingly, the thickness "T" of the cover 26 is preferably kept to the minimum permissible as dictated by design requirements for the particular intended application.

Preferably, the cross-sectional profile of the cover 26 is approximately trapezoidal (as shown in FIG. 4) or rectangular in shape. However, other possible cross-sectional shapes may be provided as a matter of design choice.

End caps 29, which are inserted into the open ends 65 of the cover 26, are depicted in FIG. 4. An end cap 29 preferably comprises an end cap closure 30 and an insertion portion 31. The insertion portion 31 of the end cap 29 has a cross-sectional shape which preferably is selected to match the cross-sectional shape of the cavity 27 in the cover 26. Preferably, the end cap 29 is sized to snugly fit into the cover 26 to assist in retaining the end cap in the cover. Preferably, press or snap fits are used to retain the end caps 29 in the cover 26. However, the end caps 29 may be retained by other suitable methods, such as, by the use of, set screws or pins, threaded fasteners, and other methods commonly known and used in the art. The bottom end closure 66 on each end of the cover 26 assist in supporting and retaining the insertion portion 31 of the end cap 29.

Preferably, the end cap closure 30 has a flanged portion 67 which projects laterally from and beyond the outer dimensions of the insertion portion 31. The outer dimensions of the flanged portion 67 are preferably larger than the outer dimensions of the cavity 27 to prevent the end cap 29 from sliding completely into the cover. Alternatively, the end cap 29 may be made to slide completely into the cover 26. The flanged portion is preferably formed from and integral with a portion of the end cap 29 which is flanged so as to protrude laterally from the end cap as shown in FIG. 4. Alternatively, the end cap closure 30 may be a separate component that is affixed to the end cap 29.

As shown in FIG. 4, the end cap 29 may have an internal bore 68 with sidewalls 72, and preferably comprises gear teeth 55 which are cooperatively designed and sized to mate with gear teeth 13, 18 of inboard and outboard gears 12, 17, respectively (see FIGS. 1–3). Preferably, the internal bore 68 is slightly elongated in the vertical direction forming a slot having a height H1. In the embodiment shown, opposing banks of gear teeth 55 are preferably provided and vertically arranged along the sidewalls 72 to form gear racks 76. During operation of the hinge 1, described in more detail below, the inboard and outboard gears 12, 17 travel vertically up and down along the gear racks 76 as the hinge is opened and closed. Preferably, as best seen in FIG. 8, the internal bore 68 does not extend through the end cap enclosure 30 to the outside. Alternatively, the internal bore 68 may extend through the end cap enclosure 30.

Referring back to FIG. 4, the internal bore 68 of the end cap 29 may also have a top portion 73 and a bottom portion 74. Preferably, the gear racks 76 do not extend into the top and bottom portions 73, 74 of the end cap bore 68. Also, the top and bottom portions 73, 74 are preferably sized and contoured in the embodiment shown in FIG. 4 to approximately match the size and contour of the inboard and outboard gears 12, 17 for reasons which will become apparent below.

The end cap 29 and end cap closure 30 may preferably be made from aluminum, brass, steel, titanium, alloyed metals, plastic, or any other suitable material as commonly known and used in the art. If a separate end cap closure 30 is used, the end cap 29 and the end cap closure need not necessarily be made from the same material and may be different.

Figure 5:
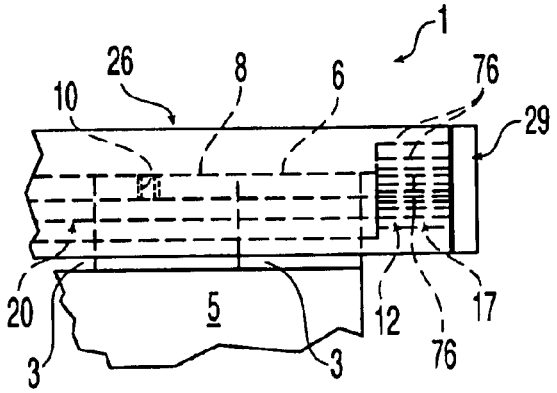
FIG. 5 is a cross-sectional side view of an end portion of a hinge according to principles of the present invention.

FIG. 5 is a side view of a covered pin hinge 1 showing the relationship between some of the foregoing components when assembled in the cover 26. As shown, the inboard and outboard gears 12, 17 are engaged with the gear racks 76 (shown in FIG. 4) of the end cap 26. The knuckles 6, 8 of hinge members 2, 4, respectively, are positioned inside the cover 26 and substantially hidden from view, providing an aesthetically pleasing appearance for the pinned hinge 1 and protecting the knuckles.

Figure 11A:
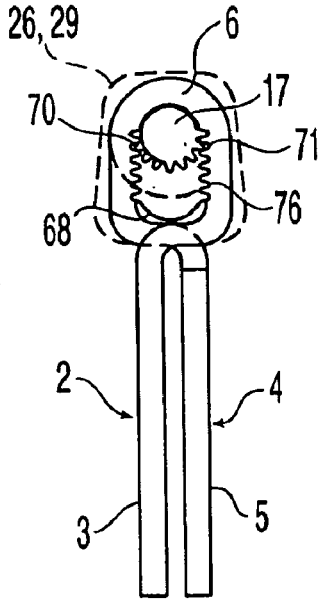
FIG. 11A is an end view of a hinge according to principles of the present invention shown in the "hinge closed position," wherein the end cap and cover are shown in cross-sectional outline.
Figure 11B:
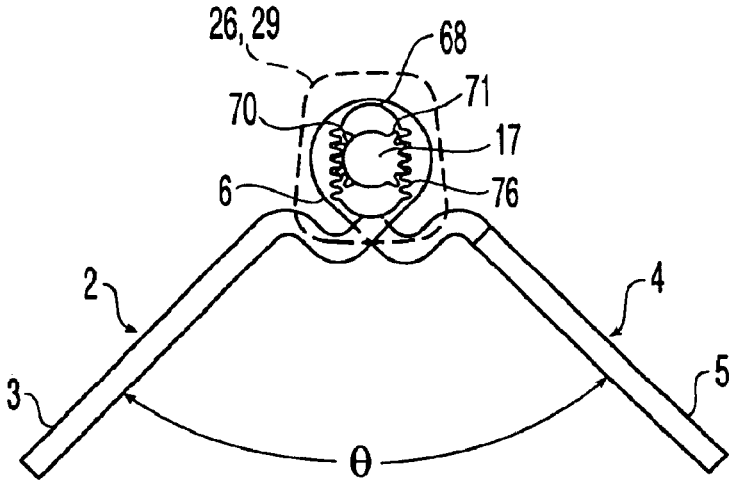
FIG. 11B is an end view of a hinge according to principles of the present invention shown with the hinge between the hinge closed and open positions, wherein the end cap and cover are shown in cross-sectional outline.
Figure 11C:
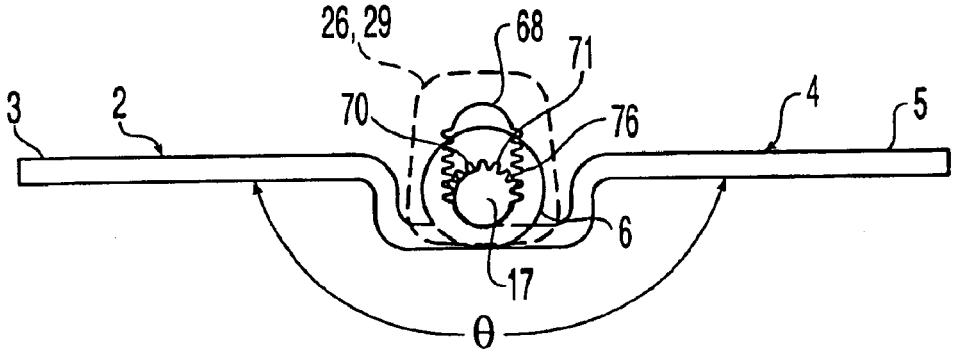
FIG. 11C is an end view of a hinge according to principles of the present invention shown in the "hinge open position," wherein the end cap and cover are shown in cross-sectional outline.

The operation of the covered pin hinge 1 will now be described with particular reference to FIGS. 6, 7, and 11A–C, and with continuing reference to FIGS. 1–5. It should be noted that the bottom end cap 29 and the cover 26 are not shown in FIGS. 6 and 7 to better illustrate the movement of the inboard and outboard gears 12, 17 during operation of the pinned hinge 1. FIGS. 11A–C show the outline of the end cap 29 and cover 26 (in dashed lines) to more clearly reveal the operation of the hinge members 2, 4. The internal bore 68 and gears racks 76 of the end cap 29 are shown (in solid lines) to reveal the interaction of the gear racks with the gear tooth segments 70, 71 of the inboard and outboard gears 12, 17, respectively. It should also be noted that in FIGS. 11A–C, outboard gear 17 is fully visible, while only the top of the gear tooth segment rack 70 of inboard gear 12 is visible.

FIGS. 6 and 11A show the covered pinned hinge 1 in the closed position with the leaves 3, 5, of hinge members 2, 4, respectively, in relatively close proximity to each other. In the embodiment shown, the gear tooth segment 71 of the outboard gear 17 starts off in the lower right quadrant position of the outboard gear, and the gear tooth segment 70 of the inboard gear 12 starts off in the lower left quadrant position of the inboard gear; the positions of the gear tooth segments being identified when viewed from the end of the pinned hinge 1.

In the "hinge closed position," both the inboard and outboard gears 12, 17 preferably are in the upper part of the internal bore 68 of the end cap 29 as noted by the position of the top end cap in FIGS. 6 and 11C (internal bore 68 is not visible in FIG. 6).

Figure 7:
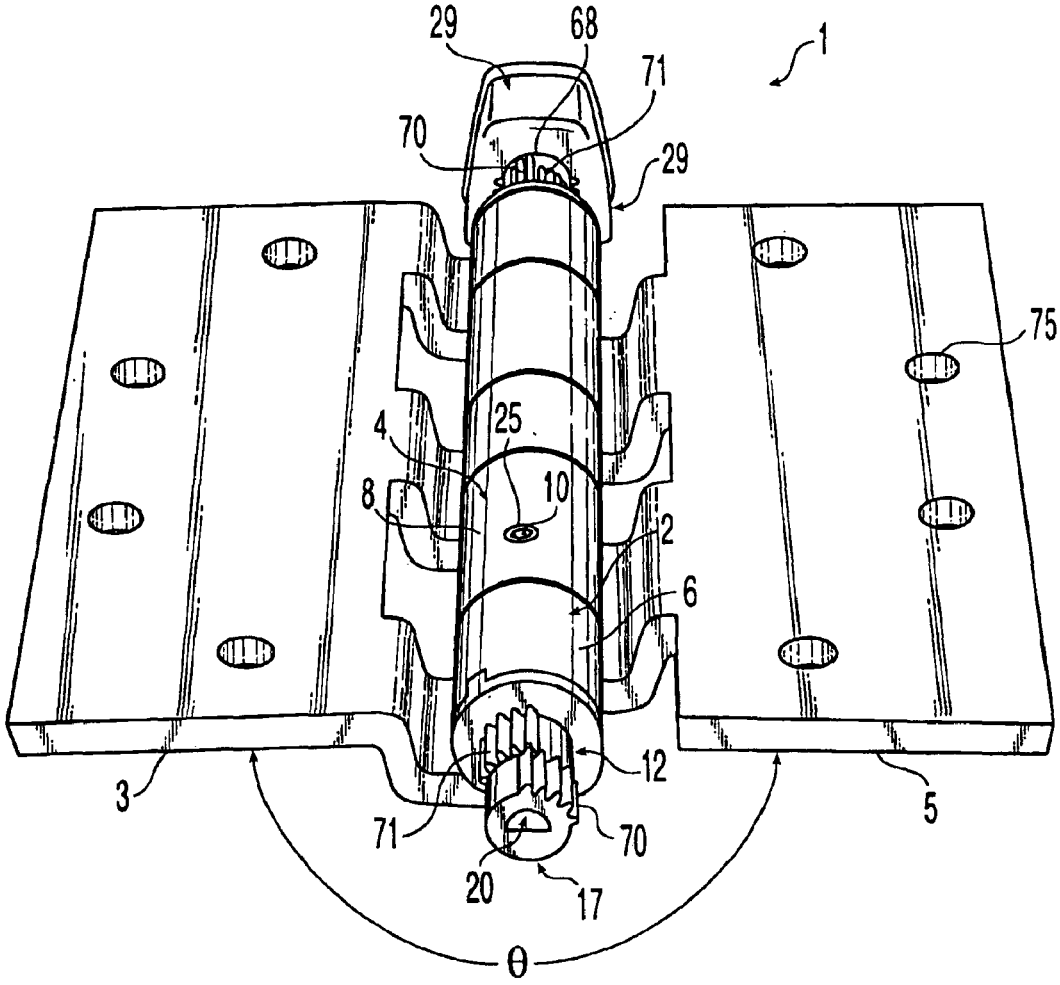
FIG. 7 is a perspective view of a hinge according to principles of the present invention shown in the "hinge open position" with the bottom end cap and the cover removed.

In the embodiment shown, as the hinge 1 is opened, the leaves 3, 5 of hinge members 2, 4 pivot around the pin 20 progressively to the "hinge open position" shown in FIGS. 7 and 11C. FIG. 11B shows the hinge 1 between the closed and open positions. As the hinge 1 is opened, outboard gear 17 and knuckles 8 of hinge member 4 all rotate in a counterclockwise direction around the pin 20. The gear tooth segment 71 of the outboard gear 17 travels vertically down along the gear rack 76 of the end cap 29. Concomitantly, the inboard gear 12 and knuckles 6 of hinge member 2 all rotate in a clockwise direction around the pin 20. The gear tooth segment 70 of the inboard gear 12 also travels vertically down along gear rack 76 of the end cap 29. As the inboard and outboard gears 12, 17 are rotated in the end cap 29, the end cap and cover are displaced or moved upwards with respect to the pin 20 by the gears (compare FIGS. 11A–C). This allows more clearance for leaves 3, 5 to swing around the edges of the cover 26 as the hinge 1 is moved to the open position (note FIG. 11C). In one embodiment, the cover 26 is displaced linearly with respect to the pin 20.

In the embodiment shown in FIGS. 7 and 11C, as the hinge 1 reaches the open position, the gear tooth segment 71 of the outboard gear 17 ends up in the upper right quadrant position of the outboard gear, and the gear tooth segment 70 of the inboard gear 12 ends up in the upper left quadrant position of the inboard gear; the positions of the gear tooth segments being identified when viewed from the end of the pinned hinge 1. In the "hinge open position," both the inboard and outboard gears 12, 17 preferably are in the lower part of the internal bore 68 of the end cap 29 (best seen in FIG. 11C).

Although leaves 3, 5 are shown in FIGS. 7 and 11C as being angularly displaced or opened by about 180 degrees (angle θ) with respect to each other, from their initial starting position shown in FIGS. 6 and 11A, the leaves may be opened to a position greater than 180 degrees depending on the design requirements and physical limitations of the specific intended application. Conversely, the leaves 3, 5 may be opened to any angular position less than 180 degrees from their initial starting position depending on the requirements and physical limitations of the specific intended application.

It will be apparent that the size and configuration of the end cap bore 68 may be selected to interact with inboard and outboard gears 12, 17 so as to form a stop to limit the angle to which the hinge 1 may be opened or closed. For example, as the hinge 1 is opened and inboard and outboard gears 12, 17 move downwards in the end cap 29, the inboard and outboard gears will eventually abut the bottom 74 of the end cap bore 68 similar to the situation shown in FIG. 4 (note that only the outboard gear 17 is depicted for clarity). This abutting relationship between the gears 12, 17 forms a stop which limits any further opening of the hinge 1. Therefore, selecting the vertical length of the bore 68, and the vertical location of the bottom of the bore in the end cap 29 can be used to regulate the angular displacement or degree (angle θ) to which the hinge 1 may be opened. Conversely, as the hinge 1 is closed, inboard and outboard gears 12, 17 move upwards in the end cap 29 eventually abutting the top 73 of the end cap bore 68. This abutting relationship forms a stop which limits any further closing of the hinge 1. In situations where the full required degree of swing for the hinge 1 cannot be predetermined, and/or to provide for commercial versatility, it may be desirable to make the height H1 of the internal bore 68 large enough to accommodate a variety of installation conditions that may be encountered during field installation.

In one embodiment, the angular position of the cover 26 remains relatively constant with respect to the hinge members 2, 4 as they are opened and closed, and as the cover concomitantly is displaced with respect to the pin 20 as described above. Thus, with reference to FIGS. 4 and 7, the hinge 1 may be designed such that the vertical axis VA1 of the hinge cover 26 approximately evenly bisects the angle θ formed by the leaves 3, 5 of hinge members 2, 4 throughout the angular displacement of the leaves and displacement of the cover.

By minor modifications to the design, which is well within the purview of those skilled in the art, the cover 26 may be designed to accommodate any special spatial constraint or aesthetic requirements that might be encountered in certain installations. Accordingly, a variety of different paths of the cover 26 are possible. For example, the cover 26 may move arcuately and rotate slightly more towards one or the other of the leaves 3, 5 as the cover is displaced. In this latter situation, the vertical axis VA1 of the cover 26 may shift towards one or the other leaves 3, 5 resulting in an uneven bisection of the angle θ as the hinge members 2, 4 are opened and closed, and the cover is displaced. In another embodiment, elliptical gears moving against a curvilinear rack within the end cap may be provided.

Figure 12:
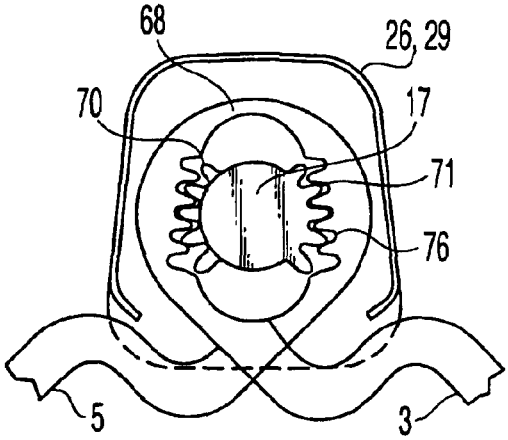
FIG. 12 is an end view of a hinge according to principles of the present invention having inboard and outboard gears of a non-circular shape.
Figure 13A:
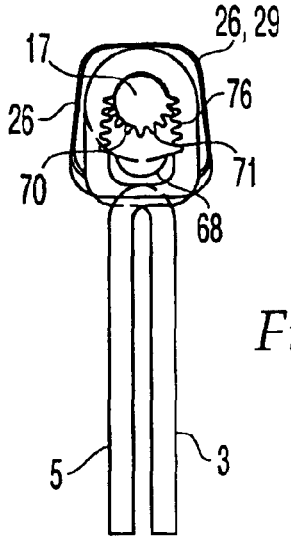
FIG. 13A is an end view of a hinge of FIG. 12 shown in the "hinge closed position," wherein the end cap and cover are shown in cross-sectional outline.
Figure 13B:
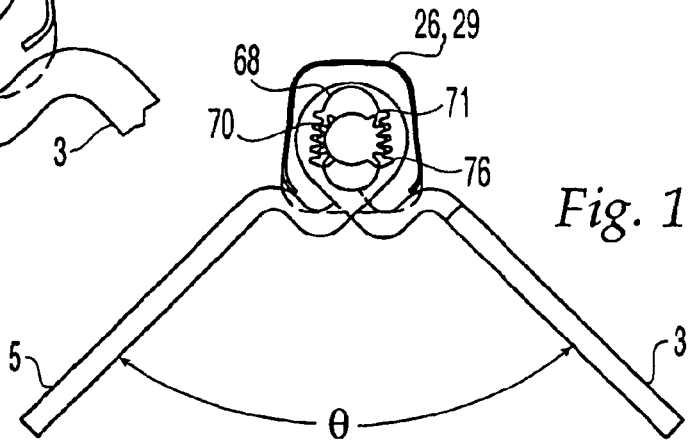
FIG. 13B is an end view of a hinge of FIG. 12 shown with the hinge between the hinge closed and open positions, wherein the end cap and cover are shown in cross-sectional outline.
Figure 13C:
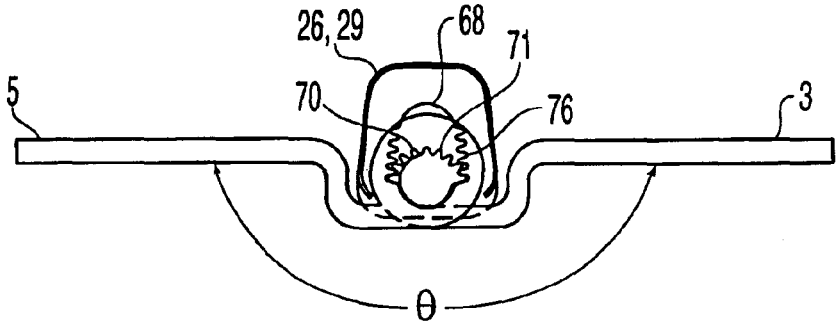
FIG. 13C is an end view of a hinge of FIG. 12 shown in the "hinge open position," wherein the end cap and cover are shown in cross-sectional outline.

As long as the pitch line of the gear segment is matched by a corresponding variation from a straight pitch line rack, the covered pinned hinge system will function properly. If the two gear sectors 70, 71 on the inboard and outboard gears 12, 17 at each end were symmetrical, even though non-circular, and if the rack were also symmetrically mated to such gears of non-circular shape, as shown in FIG. 12, the cover 26 would still move symmetrically and linearly in a straight line (see FIGS. 13A–C). As noted in FIG. 12, the right side of outboard gear 17 is slightly elongated and cam shaped and the teeth are longer at the bottom of the gear segment 71 than at the top. Obviously, in other embodiments, if the gear sectors 70, 71 of the inboard and outboard gears 12, 17 have different pitch radii or shape, the cover could be made to move asymmetrically, or even in an "S" curve or other shape as a matter of design choice.

The advantages afforded by placing the hinge cover 26 coupling or engagement mechanism (i.e., inboard and outboard gears 12, 17 and end caps 29) beyond the ends of the hinge knuckles 6 will be readily apparent to those of ordinary skill in the art, and represents a significant and novel improvement. For example, U.S. Pat. No. 5,991,975 discloses, inter alia, mechanical articulation of the hinge cover by placing gear segments generally between the ends of a butt hinge knuckles. The teeth of the gear segments disclosed therein protrude above the circumferential profile of the knuckles to engage the gear racks located inside the cover. In some situations, this may result in a cover that is larger in cross-sectional profile than desirable. In a hinge formed according to the principles of the present invention, placing the gear segments on the inboard and outboard gears 12, 17 in the manner described herein allows the cross-sectional profile of the cover 26 to be kept to a minimum, as described below.

Figure 2A:
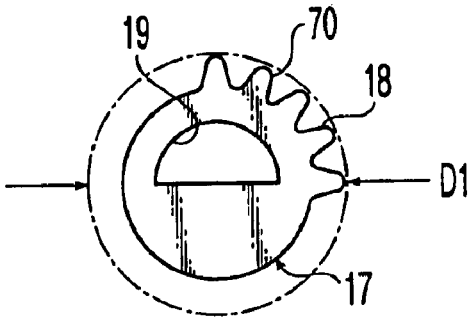
FIG. 2A is an end view of the outboard gear of the hinge of FIG. 1 wherein an imaginary circle circumscribed by the gear teeth peaks upon rotation of the outboard gear is shown.
Figure 2B:
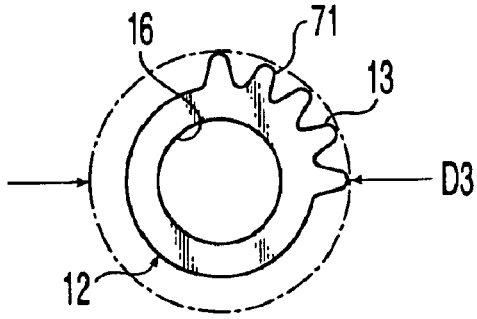
FIG. 2B is an end view of the inboard gear of the hinge of FIG. 1 wherein an imaginary circle circumscribed by the gear teeth peaks upon rotation of the inboard gear is shown.

As shown in FIGS. 2A and 2B, gear tooth segments 70 and 71 of inboard and outboard gears 12, 17 are preferably designed so that the gear teeth 13, 18 do not protrude beyond the circumferential profile of the knuckles 6, 8 of hinge members 2, 4. Accordingly, the height of the gear teeth 13, 18 are selected so that diameters D1 and D3, represented by the diametrical measurement of an imaginary circle circumscribed by the rotating peaks of the gear teeth as shown, are less than or equal to the outside diameter D2 of knuckle 6 (shown in FIG. 1). Since the gear racks 76 which engage inboard and outboard gears 12, 17 are formed in the end caps 29 which lie beyond the ends of the hinge knuckles 6 (see, e.g., FIG. 3), the cover 26 may be made to closely fit over knuckles 6, 8 of the hinge 1 with just sufficient clearance to avoid interference with the proper operation of the hinge and the mechanically articulated cover. Thus, a minimum cross-sectional profile, slimmer cover 26 is possible.

It should be noted that the gear teeth, however, may be sized to project beyond the circumferential profile of knuckles 6, 8 if a minimum cross-sectional profile cover 26 is not desired.

The covered pinned hinge of the invention may be mounted to hinged objects by any means commonly known to those skilled in the art. For example, FIG. 7 shows an array of attachment holes 75 in leaves 3, 5 through which threaded fasteners may placed to mount the hinge 1 to objects. Such objects may be, for example, but are not limited to an ingress/egress door and door jamb. Alternatively, hinge 1 may be mounted to hinged objects by any other suitable means. The covered pinned hinge, however, is expressly not limited to use in door installations, but may be used in any application where a pivotable connection between the objects is desired.

FIG. 8 shows a covered pinned hinge formed in accordance with the principles of the present invention. As shown, the cross-sectional profile of the cover 26 is relatively slim and the knuckles 6, 8 of the hinge 1 (shown in FIGS. 6 and 7, for example) are not visible, thereby providing an architecturally interesting and aesthetically pleasing appearance. In the embodiment shown, only a portion of the leaves 3, 5 are visible.

It follows that a hinge made according to principles of the present invention offers a significant opportunity for architectural and artistic versatility and expression. For example, the cover may have variously shaped cross-sectional profiles, and vary in length and size as a matter of design choice. In one embodiment, the cover may be formed of metal for durability, but be provided with a pair of parallel ridges or recesses running longitudinally on the bottom of the cover near the edges to accept releasably interlocking, non-structural decorative snap-on plastic outer jackets which may be offered with innumerable artistic designs and in unlimited colors. In other embodiments, the outer surface of the cover may be provided with a variety of finishes, textures, or designs.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A pinned hinge comprising:

first and second hinge members;

a pin pivotally connecting the first and second hinge members together, the pin having two ends, at least one end having a drive member;

an elongated hinge cover having two ends, at least one end of the cover having a driven member mechanically coupled to the drive member of the pin;

whereby angularly opening and closing the first and second hinge members displaces the cover with respect to the pin.

2. The hinge of claim 1, wherein the drive member is a gear.

3. The hinge of claim 2, wherein the driven member is a gear rack.

4. The hinge of claim 1, wherein the first hinge member further comprises at least one first knuckle having an outside diameter and the second hinge member further comprises at least one second knuckle having an outside diameter, the pin pivotally connecting the first and second hinge members through the first and second knuckles.

5. The hinge of claim 4, wherein the drive member has a diameter that is less than or equal to the outside diameter of at least one of the first or second knuckles.

6. A pinned hinge comprising:

first and second hinge members;

a pin pivotally connecting the first and second hinge members together, the pin having two ends and at least one gear disposed on one of the ends of the pin; and an elongated hinge cover having two ends, at least one end of the cover having gear teeth to mesh with the at least one gear and mechanically couple the cover to the pin;

whereby angularly opening and closing the first and second hinge members displaces the cover with respect to the pin.

7. The hinge of claim 6, further comprising the gear teeth of the at least one end of the cover being included in a gear rack to operably engage the at least one gear.

8. The hinge of claim 6, wherein the cover is displaced linearly with respect to the pin.

9. The hinge of claim 6, wherein the cover is displaced arcuately with respect to the pin.

10. The hinge of claim 6, further comprising at least one gear disposed on each end of the pin and each end of the cover having gear teeth to mechanically couple each end of the cover to the ends of the pin.

11. The hinge of claim 10, further comprising each end of the cover having a gear rack including the gear teeth to operably engage at least one gear disposed on each end of the pin.

12. The hinge of claim 11, further comprising two gears disposed on each end of the pin to mechanically couple each end of the cover to the ends of the pin.

13. The hinge of claim 12, further comprising each end of the cover having an opposing pair of gear racks to operably engage the gears on each end of the pin.

14. The hinge of claim 13, further comprising each end of the cover having an end cap wherein the opposing pair of gear racks are disposed.

15. The hinge of claim 13, wherein at least one gear on each end of the pin is an inboard gear disposed adjacent to and rotatably fixed to the first hinge member.

16. The hinge of claim 15, wherein at least one gear on each end of the pin is an outboard gear disposed near to and outside of the inboard gear, the outboard gear rotatably fixed to the pin.

17. The hinge of claim 16, further comprising the second hinge member rotatably fixed to the pin.

18. The hinge of claim 17, wherein a set screw rotatably fixes the second hinge member to the pin.

19. The hinge of claim 6, further comprising the cover having a vertical axis, wherein the vertical axis continually bisects an angle formed by the angular displacement of the first and second hinge members.

20. The hinge of claim 6, wherein the cover is made of metal or metal alloy.

21. The hinge of claim 6, wherein the cover is made of brass.

22. The hinge of 21, wherein the first and second hinge members are made of steel or steel-alloy.

23. The hinge of claim 6, wherein the first hinge member further comprises at least one first knuckle having an outside diameter and the second hinge member further comprises at least one second knuckle having an outside diameter, the pin pivotally connecting the first and second hinge members through the first and second knuckles.

24. The hinge of claim 23, wherein the at least one gear disposed on one of the ends of the pin has gear teeth and a diameter measured to the height of the gear teeth, the diameter of the gear being less than or equal to the outside diameter of at least one of the first or second knuckles.

25. A pinned hinge comprising:

a first hinge member including a first leaf and at least one first knuckle;

a second hinge member including a second leaf and at least one second knuckle;

a pin pivotally connecting the first and second hinge members through the first and second knuckles, the pin having two ends and a length, at least two gears disposed on each end of the pin; and an elongated cover disposed over the first and second knuckles, the cover having two ends with gear teeth to mechanically couple the ends of the cover to the ends of the pin;

wherein angularly opening and closing the first and second hinge members displaces the cover respect to the pin.

26. The hinge of claim 25, further comprising each end of the cover having an opposing pair of gear racks operably engaged with the gears on each end of the pin.

27. The hinge of claim 26, further comprising each end of the cover having an end cap in which the opposing pair of gear racks are disposed.

28. The hinge of claim 26, further comprising at least one gear on each end of the pin being an inboard gear disposed adjacent to and rotatably fixed to the first hinge member.

29. The hinge of claim 28, further comprising at least one gear on each end of the pin being an outboard gear disposed near to and outside of the inboard gear, the outboard gear rotatably fixed to the pin.

30. The hinge of claim 29, further comprising the second hinge member rotatably fixed to the pin.

31. The hinge of claim 25, wherein the first hinge member has three knuckles and the second hinge member has two knuckles.

32. A pinned hinge comprising:

a first hinge member having at least two spaced-apart first knuckles and a first leaf, the first knuckles having a first passageway therethrough for receiving a pin;

a second hinge member having at least one second knuckle and a second leaf, the second knuckle interspersed between the at least two first knuckles and having a second passageway therethrough for receiving a pin;

a pin received in the first and second passageways and pivotally connecting the first and second hinge members, the pin having two ends;

an inboard gear on each end of the pin and disposed adjacent to one of the first knuckles of the first hinge member;

an outboard gear on each end of the pine and disposed near to and outside of one of the inboard gears; and an elongated cover having two ends, the cover disposed over the first and second knuckles, the ends of the cover each having a pair of gear racks operably engaged with the inboard and outboard gear on each end of the pin;

wherein angularly opening and closing the first and second hinge members moves the cover linearly with respect to the pin.

33. The pinned hinge of claim 32, further comprising the pin being rotatably fixed with the second hinge member and the outboard gear, wherein moving the second hinge member causes the pin and the outboard gear to rotate.

34. The pinned hinge of claim 33, further comprising the inboard gear being rotatably fixed with the first hinge member, wherein moving the first hinge member causes the inboard gear to rotate.

35. The pinned hinge of claim 34, further comprising each end of the cover having an end cap, each end cap having a vertical slot with an opposing bank of vertical gear racks disposed therein;

whereby opening and closing the hinge causes the inboard and outboard gears on each end of the pin to travel up and down along the gear racks.

* * * * *